US009066379B2

(12) United States Patent
Kreye et al.

(10) Patent No.: US 9,066,379 B2
(45) Date of Patent: Jun. 23, 2015

(54) PIXEL CIRCUIT FOR AN ACTIVE MATRIX OLED DISPLAY

(75) Inventors: Daniel Kreye, Reutlingen (DE); Thomas Presberger, Dresden (DE)

(73) Assignee: Fraunhofer-Gesellschaft zur Förderung der angewandten Forschung e.V. (DE)

( * ) Notice: Subject to any disclaimer, the term of this patent is extended or adjusted under 35 U.S.C. 154(b) by 232 days.

(21) Appl. No.: 13/643,188

(22) PCT Filed: Apr. 27, 2011

(86) PCT No.: PCT/DE2011/000464

§ 371 (c)(1),
(2), (4) Date: Jan. 7, 2013

(87) PCT Pub. No.: WO2011/134461

PCT Pub. Date: Nov. 3, 2011

(65) Prior Publication Data

US 2013/0099700 A1 Apr. 25, 2013

(30) Foreign Application Priority Data

Apr. 28, 2010 (DE) ..... 10 2010 019 667

(51) Int. Cl.
*H05B 37/02* (2006.01)
*G09G 3/32* (2006.01)
*G09G 3/20* (2006.01)

(52) U.S. Cl.
CPC ..... *H05B 37/02* (2013.01); *G09G 3/3233* (2013.01); *G09G 3/2018* (2013.01); (Continued)

(58) Field of Classification Search
CPC ..... H05B 37/02; G09G 3/3233; G09G 2300/0809; G09G 2300/0842; H01L 29/04
USPC ..... 315/312–325; 345/76; 365/154
See application file for complete search history.

(56) References Cited

U.S. PATENT DOCUMENTS 6,580,657 B2 * 6/2003 Sanford et al. ..... 365/230.05
6,858,991 B2 * 2/2005 Miyazawa ..... 315/169.3
(Continued)

FOREIGN PATENT DOCUMENTS

DE 102006030541 A1 12/2007
EP 1384225 B1 1/2010

OTHER PUBLICATIONS

"International Application No. PCT/DE2011/000464, International Search Report and Written Opinion mailed Sep. 28, 2011", 12 pgs.
(Continued)

*Primary Examiner* — Jason M Crawford
*Assistant Examiner* — Nelson Correa
(74) *Attorney, Agent, or Firm* — Schwegman Lundberg & Woessner, P.A.

(57) ABSTRACT

A circuit arrangement for organic light-emitting diodes can be arranged in a two-dimensional matrix. It can in particular be used with microdisplays. It can allow a wide influencing of the brightness of the electromagnetic radiation emitted by the organic light-emitting diodes. Every organic light-emitting diode can be controlled by means of a storage circuit, a sense amplifier and a driver circuit using the circuit arrangement. The driver circuit can be formed by at least three transistors connected in series and a further output transistor whose drain is connected to the anode of the respective organic light-emitting diode. In this respect, the transistor acting as the driver can have a constant electric operating voltage LVDD applied at its source and a further likewise constant electric operating voltage $V_{drive}$ is applied to its gate. The drain of the first transistor to the source of the following transistor connected to it in series and the two gates of the following transistors which form a switch and are connected in series are connected to the output of the sense amplifier and are acted on by its electric output voltage $V_{SenseOut}$. The drains of the two transistors forming the switch are connected to the source of the output transistor whose gate is connected to ground potential or to which negative electric voltage is applied.

6 Claims, 11 Drawing Sheets

(52) U.S. Cl.
CPC ..... *G09G 3/3258* (2013.01); *G09G 3/3291* (2013.01); *G09G 2300/0809* (2013.01); *G09G 2300/0814* (2013.01); *G09G 2300/0852* (2013.01); *G09G 2300/0861* (2013.01); *G09G 2310/0251* (2013.01); *G09G 2310/0262* (2013.01); *G09G 2320/0626* (2013.01); *G09G 2320/0633* (2013.01); *G09G 2320/064* (2013.01); *G09G 2330/04* (2013.01)

(56) References Cited

U.S. PATENT DOCUMENTS

| | | | | |
|---|---|---|---|---|
| 7,317,435 | B2 * | 1/2008 | Hsueh | 345/82 |
| 7,372,440 | B2 * | 5/2008 | Ota et al. | 345/76 |
| 7,515,127 | B2 * | 4/2009 | Burns et al. | 345/82 |
| 7,777,698 | B2 * | 8/2010 | Takahara et al. | 345/76 |
| 8,018,405 | B2 * | 9/2011 | Kwak et al. | 345/82 |
| 8,115,707 | B2 * | 2/2012 | Nathan et al. | 345/78 |
| 2002/0084463 | A1 | 7/2002 | Sanford et al. | |

OTHER PUBLICATIONS

Sanford, James L., et al., "24.2 Direct View Active Matrix VGA OLED-on-Crystalline-Silicon Display", SID Symposium Digest of Technical Papers, 32(1), San Jose Convention Center, California, (Jun. 3, 2001), 376-379.

"International Application No. PCT/DE2011/000464, International Preliminary Report on Patentability issued Oct. 30, 2012", 10 pgs.

* cited by examiner

PIXEL CIRCUIT FOR AN ACTIVE MATRIX OLED DISPLAY

PRIORITY CLAIM TO RELATED APPLICATIONS

This application is a national stage application under 35 U.S.C. §371 of PCT/DE2011/000464, filed Apr. 27, 2011, and published as WO 2011/134461 A1 on Nov. 3, 2011, which claims priority to German Application No. 10 2010 019 667.3, filed Apr. 28, 2010, which applications and publication are incorporated by reference as if reproduced herein and made a part hereof in their entirety, and the benefit of priority of each of which is claimed herein.

TECHNICAL FIELD

The subject matter relates to a circuit arrangement for organic light-emitting diodes arranged in a two-dimensional matrix.

BACKGROUND

A constantly growing number of information systems and environmental influences deliver demanded and non-demanded information to people. In this respect, a mobile presentation of information has increasing importance. Microdisplays, i.e. very small displays with picture diagonals of less than or equal to 20 mm, in this respect offer the possibility of representing photographic and video information in high resolution and in a user-specific manner, i.e. for only one user or for a plurality of users. Areas of application of microdisplays can be seen in the field of near-to-eye applications. They include, for example, video glasses which can be connected to mobile multimedia devices (smartphones or mobile audio and video players). These video glasses can be used for mobile TV, video presentation or presentation of internet content. Furthermore, microdisplays can be used in digital cameras and/or video cameras as high-resolution electronic viewfinders.

A further area of application is augmented reality. The microdisplay is mounted in see-through optics (glasses) for these applications. The user sees the real environment through these glasses and additional information in the form of images, texts, graphics, etc. can be superimposed on this image via the microdisplay. This can be utilized, for example, in the servicing of complex plant and machinery for fading in assembly instructions or general instructions. In aeronautical engineering, pilots can have the display of different measurement instruments added. In medicine, the data from important devices can additionally be presented for surgeons. Furthermore, a variety of applications are conceivable in the military sector.

Further applications of microdisplays are pico projectors, i.e. very small projectors which project image and video content onto a planar surface and present it visible to a plurality of users. Such projectors with microdisplays can also be used in metrology for projecting defined patterns onto a surface to be examined and for the subsequent optical detection of the 3D structure of this surface.

Very high brightness values (>10000 Cd/m$^2$) are in particular required for projection applications and see-through applications. In contrast to this, comparatively low brightness values (≤150 Cd/m$^2$) are required for the multimedia applications and video glasses. There should be the possibility of addressing all these applications with one display for microdisplays on the basis of organic light-emitting diodes (OLEDs). In this respect, high-resolution image information having a brightness adjustable over several orders of magnitude (from <100 Cd/m$^2$ to above 10000 Cd/m$^2$) should be able to be presented. An extension of the electric current and voltage range which such a circuit has to be able to control is required for this purpose.

Currently, different microdisplay technologies are available. In this respect, it is possible to distinguish between light-modulating (non-emitting) technologies and light-emitting technologies.

The light-modulating displays include LCOS (liquid crystal on silicon) and MOEMS based microdisplays. These technologies demand an additional external illumination which increases the complexity, the size and the weight of the overall system, but simultaneously only provide limited contrast (typically <1:100).

Innovative self-emitting flat displays having many advantages can be implemented on the basis of organic light-emitting diodes (OLEDs). They include the possible large-area deposition, the self-lighting properties which allow very thin and low-power displays and the potentially high efficiency of such displays. OLED microdisplays are currently equipped with monochrome or broadband (white) emitters. For color OLED microdisplays, the primary display colors are frequently realized by a white emitter and the additional application of a color filter.

All the named technologies are formed with active and passive components (transistors and capacitors). Every organic light-emitting diode as a pixel (picture element) is controlled in this respect by its own integrated electronic circuit. This pixel circuit is designed in this respect so that it can be written with the image information in the form of an electric voltage or of a current. The image information is stored in the circuit associated with the organic light-emitting diode and this circuit drives the OLED with an electric current or with a voltage which corresponds to the stored image information.

Currently the following concepts have been realized in this respect:

1. Programming the respective circuit of an organic light-emitting diode with an analog electric current whose magnitude is proportional to the gray-scale value of the image information to be presented. This analog electric current is converted into an analog voltage and is stored by means of a capacitor. The stored electric voltage is converted into an electric current corresponding to the image information. This current influences the respective organic light-emitting diode. The brightness is in this respect set by the magnitude of the electric current which flows through the organic light-emitting diode (analog value). Gray-scale values/gradations of the brightness are realized by a correspondingly smaller electric current.
2. An electric voltage can be stored in a capacitor. The electric voltage is in this respect converted into an electric current in the circuit associated with the respective organic light-emitting diode. This current influences the brightness at which electromagnetic radiation is emitted by the organic light-emitting diode. The brightness is in this respect set by the magnitude of the electric current which flows through the organic light-emitting diode (analog value). The gray-scale value is in this respect realized as under 1.).
3. A programming of the circuit for an organic light-emitting diode can be achieved using an analog electric voltage and storing the voltage on a capacitor. The organic light-emitting diode can be operated using the stored electric voltage or a voltage whose magnitude corresponds to this stored voltage. The brightness is set by the magnitude of the electric voltage applied to the organic light-emitting diode. Gray-scale value/gradations can be realized by a correspondingly smaller electric voltage.

4. The programming of the circuit of organic light-emitting diodes can take place using digital electric voltages and storing these digital voltages/states on capacitors. The number of capacitors corresponds to the bit width of the image information for a pixel (usually 5, 6 or 8 bits). The organic light-emitting diode is controlled by a time-pulsed electric current of constant magnitude. The number of pulses per image sequence in this respect corresponds to the bit width of the image information. The length of the pulses is in this respect dependent on the value of the bits. Depending on the digital state of the individual storage capacitors of a circuit associated with an organic light-emitting diode, the electric current through the organic light-emitting diode is switched on or off for the corresponding pulse duration. The brightness of the emitted radiation can be set by the magnitude of the electric current flowing through the organic light-emitting diode. Gray-scale values/gradations are influenced by pulse width modulation of the electric current. The dynamic range of the electric current flowing through the organic light-emitting diode and the maximum voltage drop over the OLED are limited in this respect.

The field of use of microdisplays having organic light-emitting diodes is restricted to low (≤200 Cd/m$^2$) to medium brightness values (up to 5000 Cd/m$^2$), i.e. to the areas of application with the information presentation for an individual person and near-to-eye applications. The field of use is limited by the maximum presentable brightness of such microdisplays. The brightness depends on the efficiency and on the voltage requirements of the organic light-emitting diodes and the electric current and voltage driver capability of the circuit.

No solutions are known in which microdisplays having organic light-emitting diodes are utilized for projection applications and see-through applications with high maximum brightness values (≥10,000 Cd/m$^2$) and are controlled using corresponding circuits associated with the organic light-emitting diodes.

The area of use of the currently available OLED microdisplays is restricted to unidirectional, image-reproducing microdisplays. In accordance with DE 10 2006 030 541 A1, a use can also be realized in bidirectional microdisplays, i.e. microdisplays having an image presentation function and an image taking function or optical detection function.

OVERVIEW

A circuit arrangement for controlling organic light-emitting diodes can be arranged in a two-dimensional matrix as imaging elements with which circuit arrangement a large influencing of the brightness of the electromagnetic radiation emitted by the organic light-emitting diodes is possible.

This object is achieved in accordance with the invention by a circuit arrangement having the features of claim 1. Advantageous embodiments and further developments of the invention can be realized using features designated in the subordinate claims.

In the circuit arrangement in accordance with the invention for organic light-emitting diodes arranged in a two-dimensional matrix, each organic light-emitting diode can be individually controlled by means of a storage circuit, a sense amplifier and a driver circuit.

The driver circuit is in this respect formed by at least three transistors connected in series and one further output transistor whose drain is connected to the anode of the respective organic light-emitting diode. In this respect, the transistor acting as the actual driver has a constant electric operating voltage LVDD applied at its source and a further likewise constant electric operating voltage $V_{drive}$ is applied to its gate. The drain of this transistor is connected to the source of the transistor subsequently connected to it in series and the two gates of the transistors forming a switch and subsequently arranged in the series connection are connected to the output of the sense amplifier and have tis electric output voltage $V_{SenseOut}$ applied to them. The electric voltage $V_{Drive}$ is in this respect an adjustable, analog, time-constant reference voltage. This electric voltage has a value which lies between the electrical operating voltage LVDD and ground. This reference voltage can be delivered directly from the overall circuit for the display with the organic light-emitting diodes or can also be fed in from external. It determines the maximum brightness of the electromagnetic radiation emitted by the organic light-emitting diodes and can be set differently for each of the primary colors of the emitted light of the display.

The drains of the two transistors forming the switch are connected to the source of the output transistor whose gate is connected to ground potential or to which negative electric voltage is applied. The output transistor for each organic light-emitting diode is arranged in a separate electrically insulated trough of a substrate. In this respect, the connection of the trough and of the source of the output transistor are connected to one another.

The transistor whose source is connected to the transistor acting as a driver should be a PMOS transistor and the transistor whose gate is connected to the gate of the second transistor connected in series and is connected together to the output of the sense amplifier should be NMOS transistors.

It is advantageous if all elements of the circuit arrangement are formed as a CMOS circuit on a semiconductive substrate.

A further transistor can be arranged in the driver circuit between the transistor acting as a driver and the one transistor likewise connected in series for a possible switching off without any loss of initially stored image information. It can be formed as a PMOS transistor.

An electric voltage can be applied to the cathode of the respective organic light-emitting diodes which is smaller than the electric voltage which is applied to the source of the second transistor which is connected in series and forms the switch and to the gate of the output transistor connected to the anode of the organic light-emitting diode.

The gate of the transistor acting as a driver can be connected to ground potential so that this transistor can likewise form a switch of the driver circuit. In this operating mode, the driver circuit works as an electric voltage source for the organic light-emitting diode.

The circuit arrangement for each individual organic light-emitting diode can be manufactured on a very small area in an integrated implementation as a CMOS circuit. It allows a high resolution of the display. The maximum brightness of the image (full-scale deflection) can in this respect be set over several orders of magnitude from <100 Cd/m$^2$ to well above 10,000 Cd/m$^2$. The circuit arrangement is thus suitable for the use of displays for projection applications and for applications in a very bright environment (outside area with clear skies, aircraft cockpit, etc.) as well as in a very dark environment (night, rooms closed off from daylight, etc.). The presentation of gray-scale values or colors can be realized via pulse width modulation so that the linearity of input image signal to presented image is not influenced on a change of the maximum brightness. The image information can be stored digitally in every circuit arrangement associated with an organic light-emitting diode. The resolution per color and pixel is dependent on the implementation and can typically amount to 6 or 8 bits or also more.

It is favorable only to use a single transistor as a driver with an extended voltage range/withstand voltage (high-volt transistor or medium-volt transistor). The voltage driver capability is here the maximum permitted electric voltage difference over the emitting organic light-emitting diode between the electric voltage over the organic light-emitting diode in the maximally controlled state (highest brightness value) and the electric voltage over the organic light-emitting diode in the dark state (lowest brightness value).

Parameters to be taken into account can in this respect be:

adjustable current driver capability of the driver circuit over several orders of magnitude of the electric current (powers of 10) without influencing the linearity;

possibility of switching off the total display for a defined time period without changing the image content stored for each individual organic light-emitting diode.

BRIEF DESCRIPTION OF THE DRAWINGS

The subject matter will be explained in more detail by way of example in the following.

There are shown.

DETAILED DESCRIPTION

Figure 1:
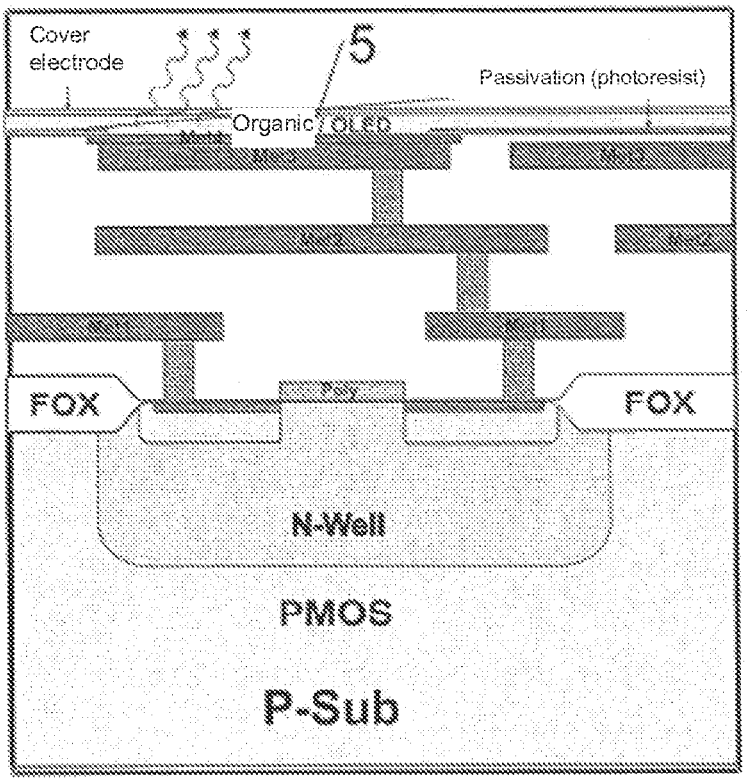
FIG. 1 a schematic cross-section through a microdisplay with organic light-emitting diodes.

Microdisplays having organic light-emitting diodes 5 are preferably designed so that they include organic layers (OLEDs) emitting light on an flow of electric current on the top-metal plane of a CMOS substrate. They can be activated locally, i.e. as so-called pixels, in that electric current flows locally through the organic light-emitting diode 5 over an electrode of the organic light-emitting diode 5. Active and passive components (as a rule transistors and capacitors) which take over the control of every individual organic light-emitting diode 5 can be located beneath the electrode in a matrix-like pixel cell arrangement. In FIG. 1, the schematic cross-section through an OLED microdisplay is shown.

Figure 2:
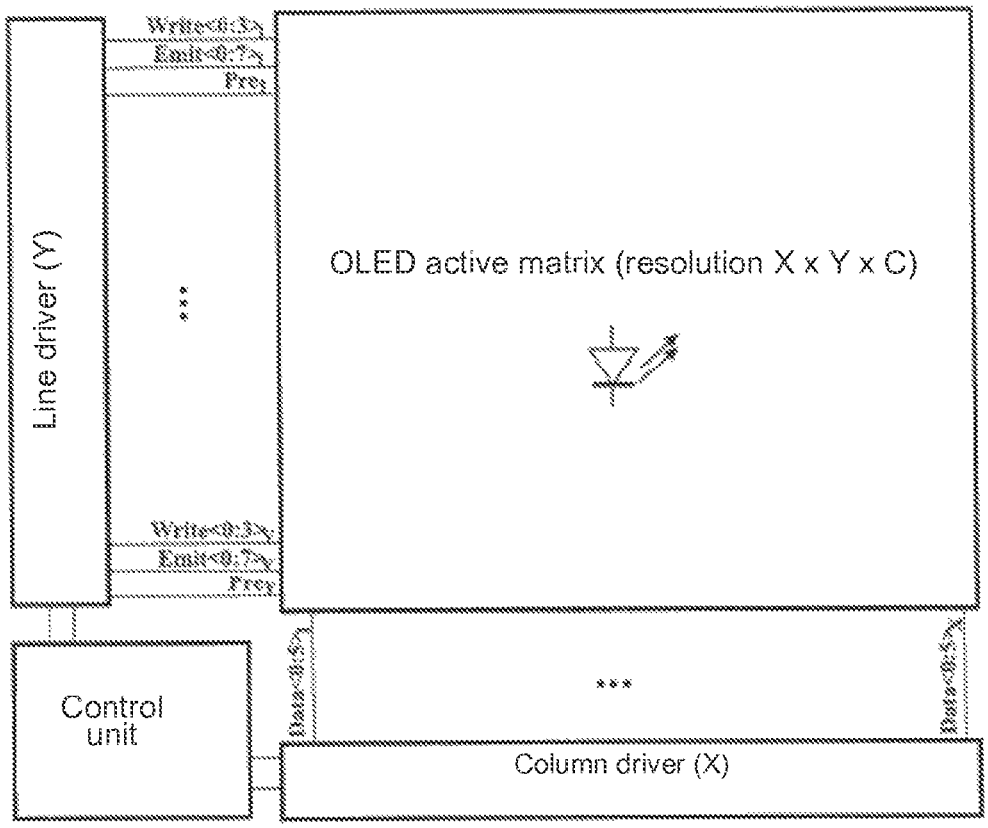
FIG. 2 in schematic form, a block diagram of a control for organic light-emitting diodes arranged two-dimensionally in a matrix.

The individual stores for organic light-emitting diodes 5, which are arranged in rows and columns, are written by a corresponding circuit, as shown in FIG. 2. In this respect, the image input data are received by an electronic control mechanism. It forwards the data to the column driver which buffers the image data for an image row. Subsequently, the row to be written is selected via a row driver and is written using the image data buffered in the column driver. In accordance with this principle, all rows of the matrix arrangement are sequentially programmed with their corresponding image content. Subsequently, the writing of the image data of the first row is started for the following image.

The transfer of the image data from the control mechanism to the column driver, the buffering in the column driver and the programming of the matrix are usually implemented using digital signals.

Figure 3:
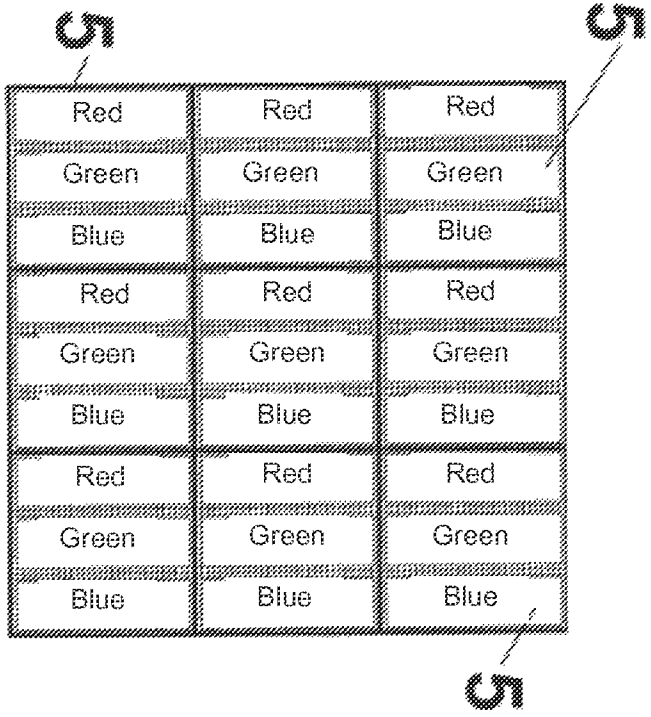
FIG. 3 in schematic form, a matrix arrangement of organic light-emitting diodes which emit electromagnetic radiation with different wavelengths, that is different red, green and blue colors.
Figure 4:
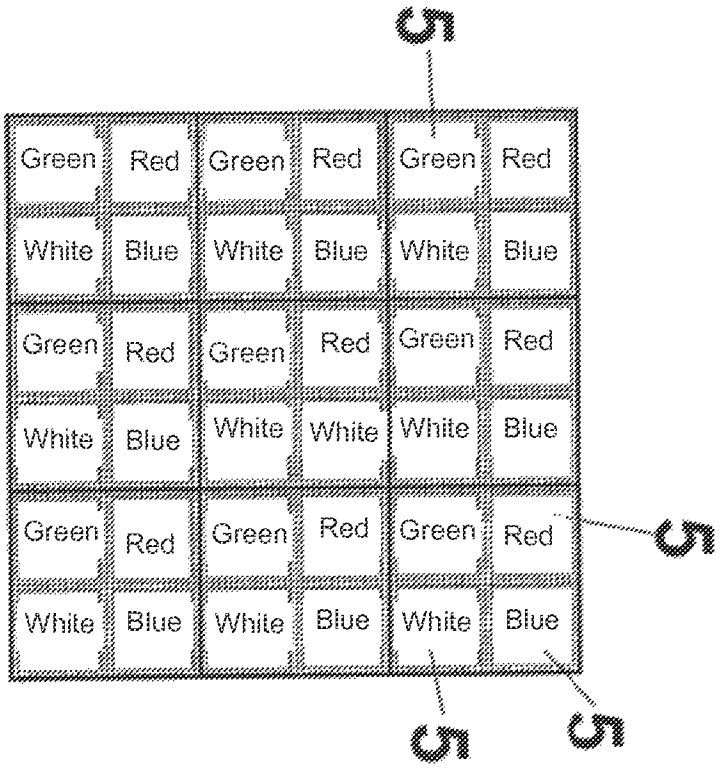
FIG. 4 in schematic form, a matrix arrangement of organic light-emitting diodes which emit electromagnetic radiation with different wavelengths, that is different red, green blue and white colors.

Each pixel cell can be divided into pixel subcells, which each pixel subcell being responsible for storing and presenting one primary color of the display. The arrangement of the primary colors can be implemented as shown in FIG. 3 and FIG. 4. Other implementations are also conceivable, however. Each of these pixel subcells in this respect represents an individual organic light-emitting diode 5 which should be separately controllable.

Figure 5:
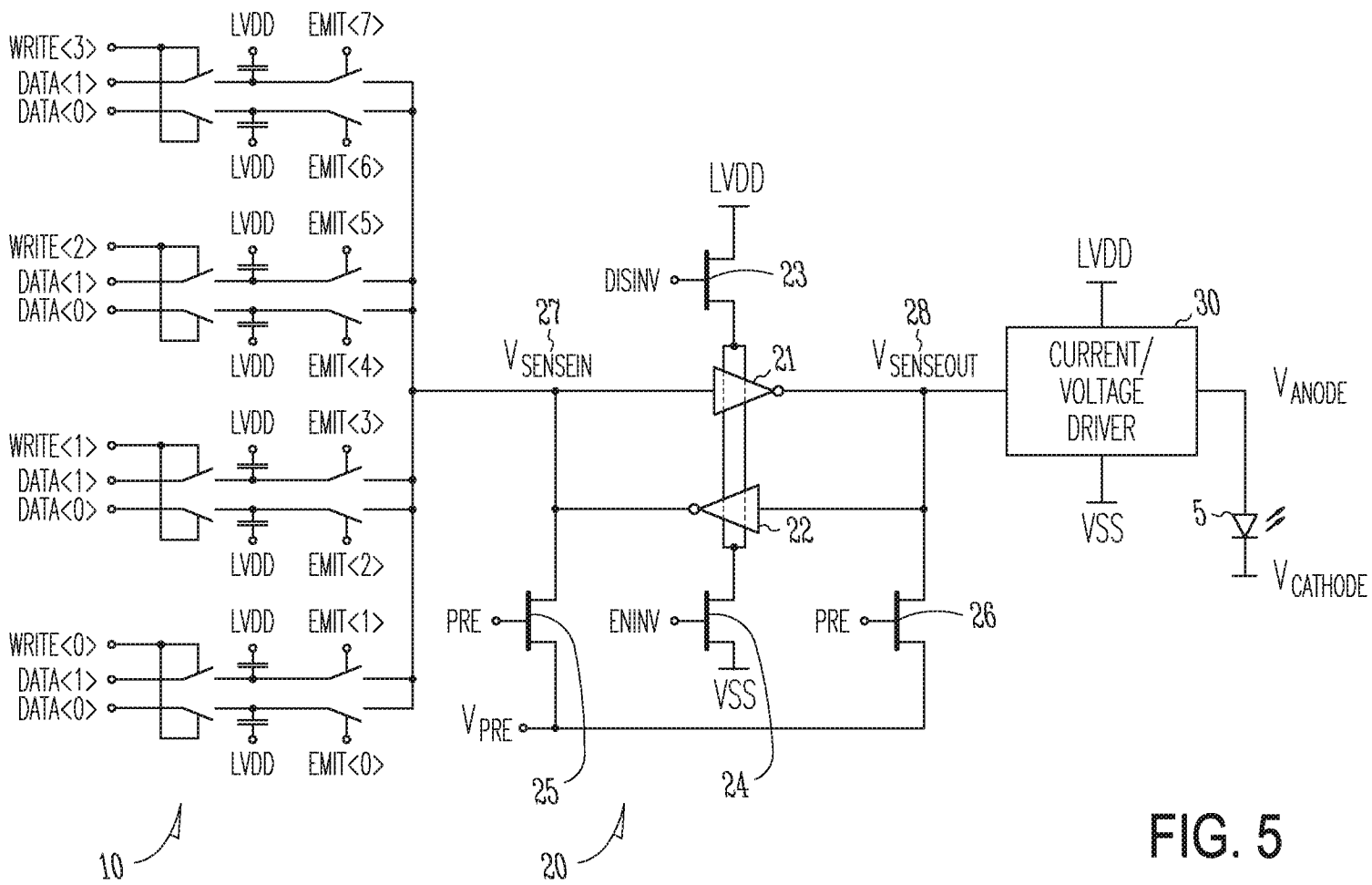
FIG. 5 a block diagram of an example of a circuit arrangement in accordance with the invention for image information which can be stored with eight bits in each case, in which capacitors are used in the storage circuit for storing.
Figure 6:
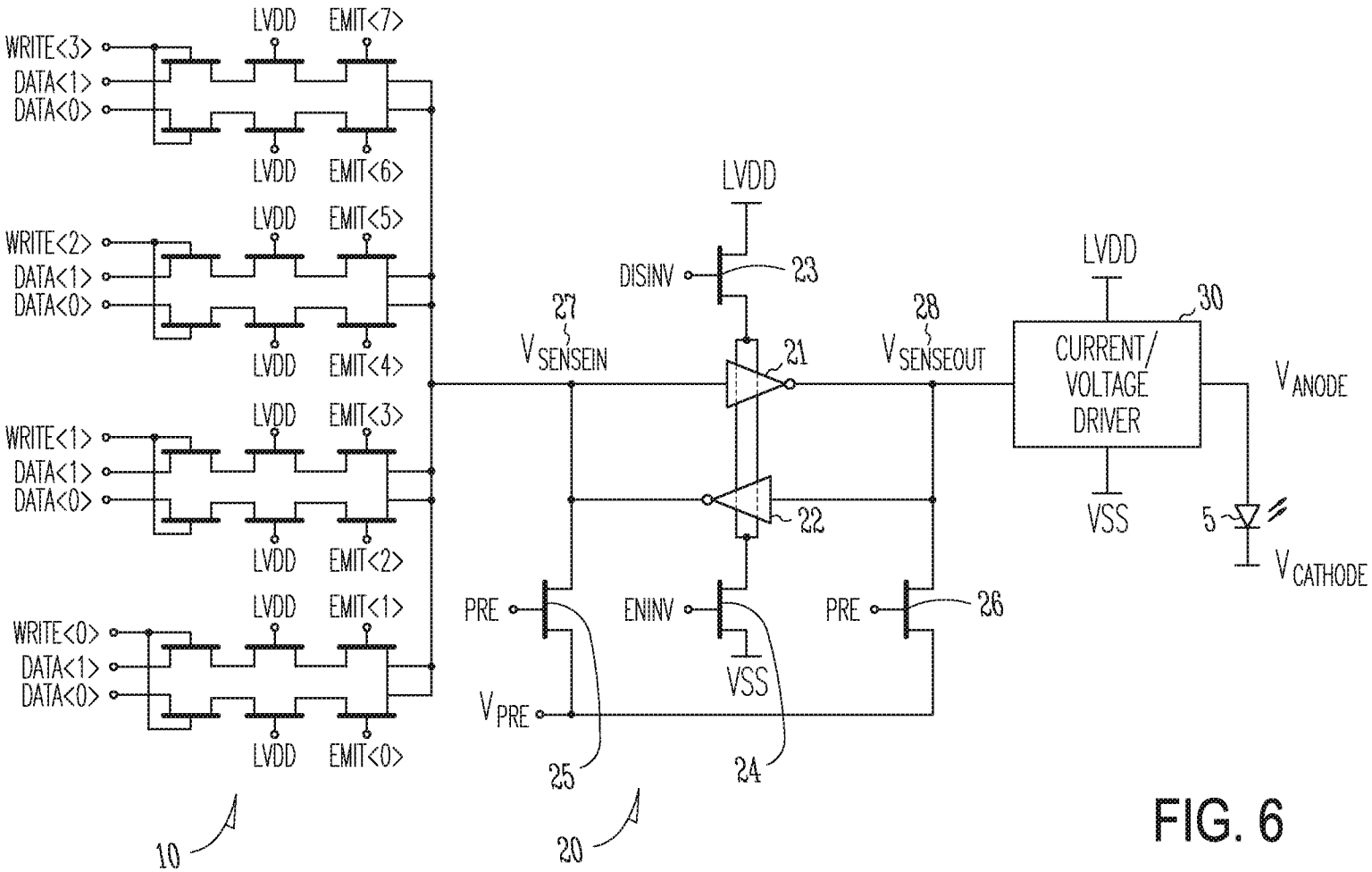
FIG. 6 a block diagram of an example of a circuit arrangement in accordance with the invention for image information which can be stored with eight bits in each case, in which transistors are used in the storage circuit for storing.

Each circuit arrangement for the control of every organic light-emitting diode (pixel subcell) 5 is in this respect composed of three circuit parts. They are a storage circuit (pixel store) 10, a sense amplifier 20 and the actual driver circuit 30 for the individual organic light-emitting diodes 5. The memory circuit 10 thus comprises as many memory cells as the color depth (in bits) requires for the respective color. As a rule, there will be 5, 6 or 8 memory cells or bits of color depth. In FIG. 5, the memory circuit 10 for an individual organic light-emitting diode 5 or for a pixel subcell is shown schematically. The individual storage cells of the storage circuit 10 in this respect each comprise a capacitor and two switches which can be implemented as transistors. For miniaturization, the capacitor can also be implemented as a transistor with a short-circuited drain and source, as is shown in FIG. 6. In addition, the data lines and programming lines were combined so that two data lines (data<0> and data<1> in FIG. 5 and four writing/programming lines (write<0> to write<3>) are used for each individual organic light-emitting diode 5. Two respective storage cells can thus be written in parallel for each organic light-emitting diode 5 and the writing of an image row is divided for the given arrangement with eight bits of pixel storage into four programming phases in which a respective two storage cells are written, activated via the programming lines.

Figure 7:
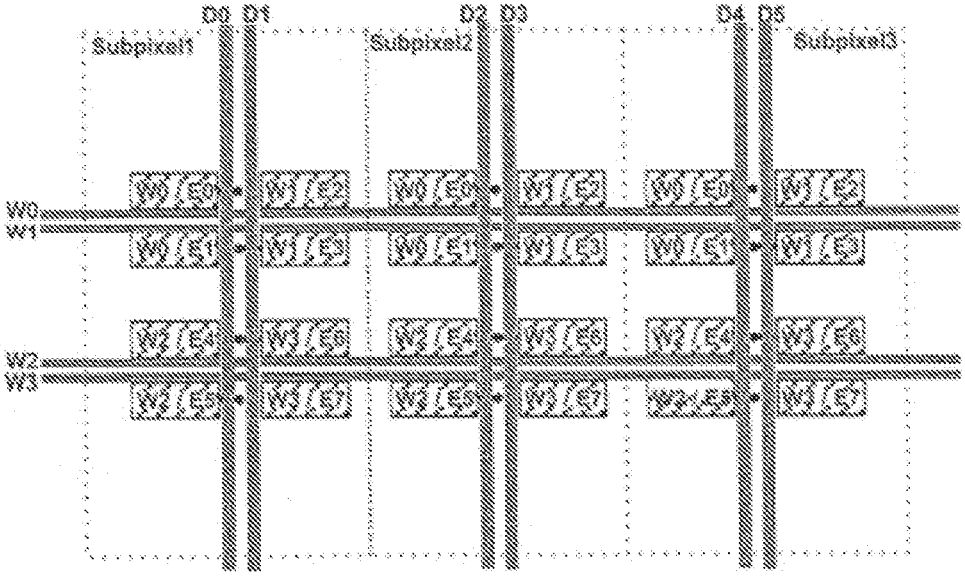
FIG. 7 a schematic arrangement for a control and storage of image information of individual organic light-emitting diodes.
Figure 8:
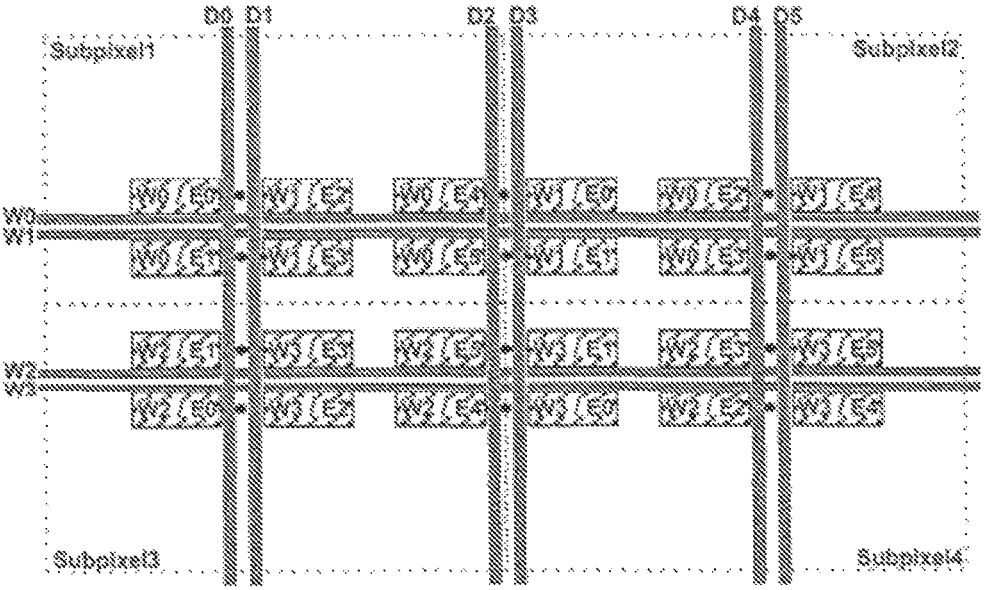
FIG. 8 a schematic arrangement for a further possibility for the control and storage of image information of individual organic light-emitting diodes.

The arrangement of the storage circuits 10 and of the corresponding data and programming lines for a pixel cell comprising three organic light-emitting diodes 5, of eight bits of color depth each, which is shown in FIG. 7. The arrangement for a pixel cell having four organic light-emitting diodes 5 of six bits of color depth each is shown in FIG. 8. The hatched rectangles in this respect represent the stores, with the corresponding programming line (e.g.: W0) and the corresponding readout line (e.g.: E0) being indicated for the storage circuit 10.

Figure 9:
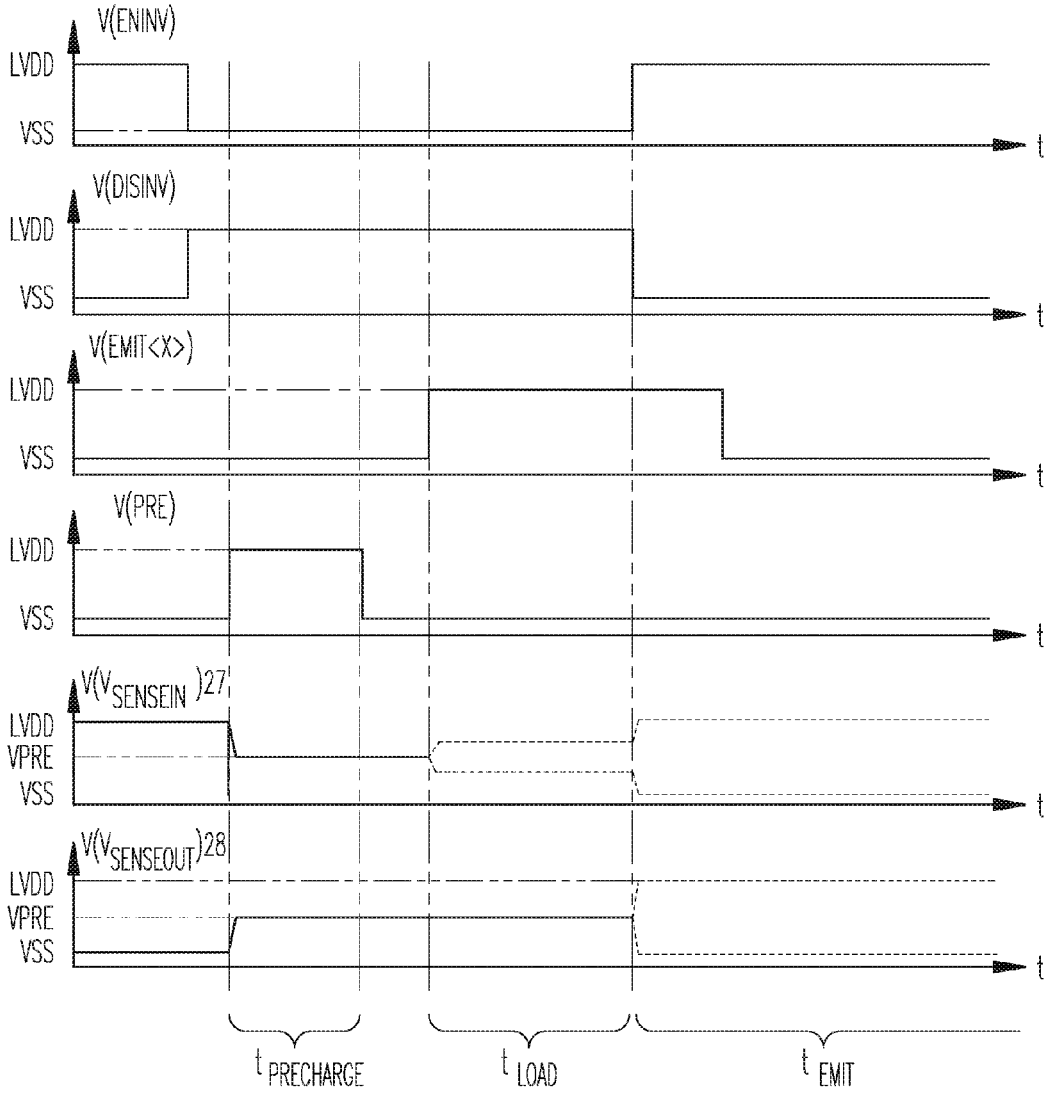
FIG. 9 time curves of the electric operating voltages of the driver circuit on a readout of the storage circuit.

To read out the stored image information, the sense amplifier 20 is used which is present for each organic light-emitting diode 5 in accordance with FIG. 5. The sense amplifier 20 in this example comprises two closed-loop inverters 21 and 22 which can be separated from the electric operation voltage supply (VSS and LVDD) via two switch-forming transistors 23 and 24. Furthermore, the inputs and outputs of these inverters 21 and 22 are prechargeable with an electric voltage Vpre via two transistors 25 and 26 as switches (activation with the signal Pre). The reading out of the image information can in this respect, as shown in FIG. 9, with graphical illustration, take place, in three phases. They are the precharge phase, the load phase and the emit phase. First, the inverters 21 and 22 are separated from the operating voltage lines (LVDD and VSS). Then, the nodes $V_{SenseIn}$ 27 and $V_{SenseOut}$ 28 are precharged to the electric voltage $V_{Pre}$. Subsequently, the storage circuit 10 to be read out is activated by the corresponding switch (Emit), whereby the electric voltage at the node $V_{SenseIn}$ 27 is either raised in the direction LVDD (with a stored high value) or lowered in the direction VSS (with a low value). The sense amplifier 20 tilts into one of the two stable states depending on the storage value by switching in the electric operating voltage at the closed-loop inverters 21 and 22 so that the negated signal from the previously read-out storage circuit 10 is applied to the output $V_{SenseOut}$ and the stored value in the storage circuit 10 can simultaneously be renewed.

The output of the sense amplifier 20 activates the driver circuit 30 for the organic light-emitting diode 5 and electromagnetic radiation (light) is emitted. In this respect, all bit stores are read out sequentially per image cycle and the content is displayed accordingly. Depending on the value of the corresponding bit, the time duration of the emitting phase will be of differing length. A pulse-width modulated imaging process is thereby implemented. The actual image information is reconstructed by time integration of the transmitted light in the eye of the viewer.

Figure 10:
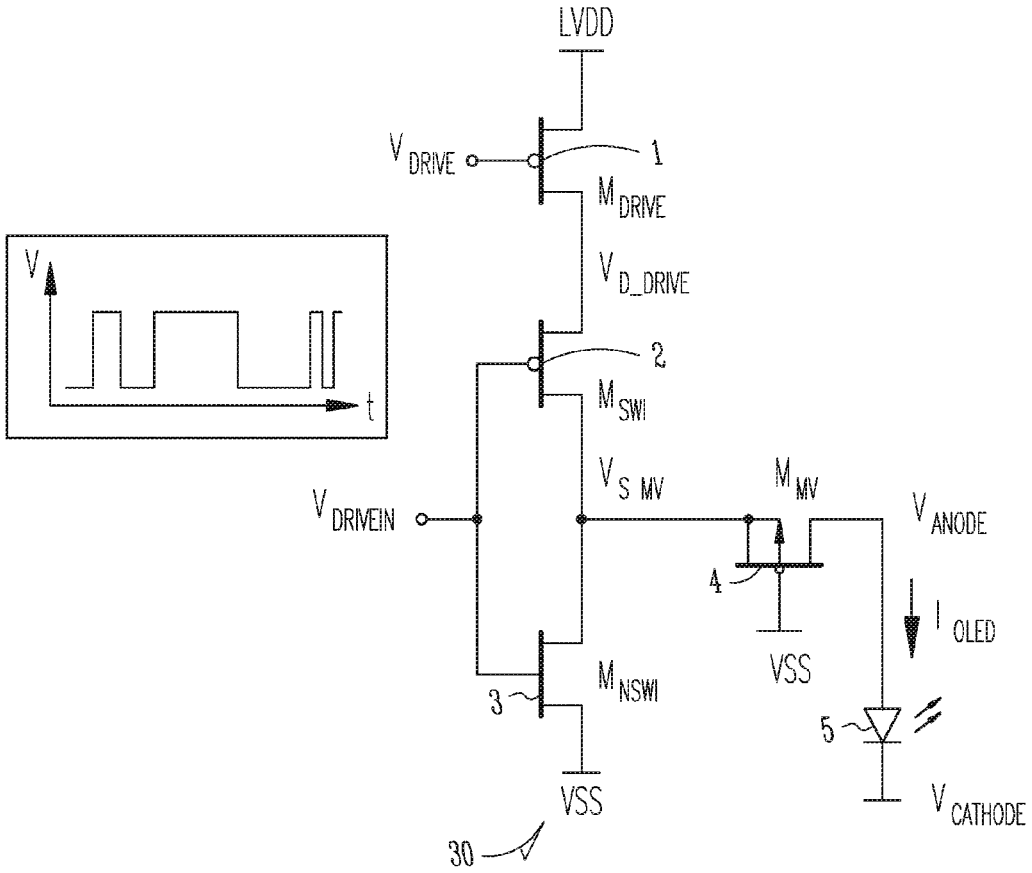
FIG. 10 an example for the design of a driver circuit.

The storage circuit 10 and the sense amplifier 20 of an organic light-emitting diode 5 comprise only low-volt transistors (NMOS and PMOS transistors) and require two operating voltage lines LVDD and VSS. The third part of the overall circuit arrangement for an organic light-emitting diode 5, the driver circuit 30, is shown in an exemplary design in FIG. 10. The driver circuit 30 comprises two low-volt PMOS transistors $M_{Drive}$ 1 and $M_{Swi}$ 2, a low-volt NMOS transistor $M_{NSWi}$ 3 and only one medium-volt or high-volt PMOS transistor $M_{MV}$ 4 with a separate trough connector. The driver circuit 30 only requires the operating voltage lines LVDD and VSS as well as a common feed for the cathode voltage $V_{Cathode}$ of the organic light-emitting diodes 5 for the overall display. The special feature for this driver circuit 30 is the fact that $V_{Cathode}$ can be more negative than VSS (ground).

Figure 11:
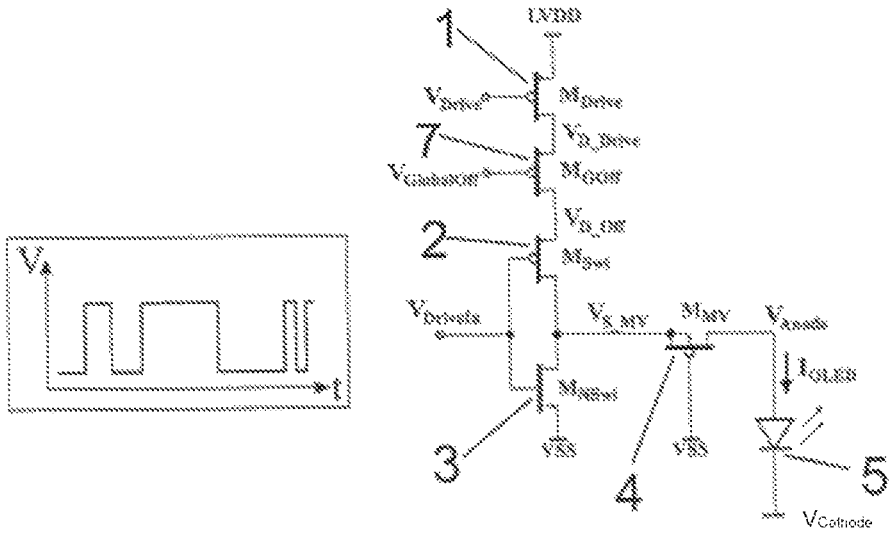
FIG. 11 a further example for a driver circuit which can be used in the invention.

FIG. 11 shows a second variant for a driver circuit 30 which can be used in the invention. In this respect, an additional switch $M_{GOff}$ is used with a further transistor 7, which is formed as a low-volt PMOS transistor and can be used for the switching off of the respective organic light-emitting diode 5. The further transistor 7 is likewise connected in series.

The entire display can be deactivated via these transistors 7 without the stored image information being lost. This deactivation function can be utilized, for example, when additional optical sensors (not shown) are integrated on the microdisplay chip and they should be optically decoupled from the microdisplay (and the transmitted light of the organic light-emitting diodes), as is described in DE 10 2006 030 541 A1; such optical sensors can e.g. be cameras.

Depending on the electric input voltage signal $V_{DriveIn}$ (connected to $V_{SenseOut}$) of the sense amplifier 20, it is possible to make a distinction for two operating modes of the overall circuit arrangement.

If the electric input voltage signal is connected to VSS (low), the driver circuit 30 is activated. In this case, the transistor $M_{NSWi}$ 3 is high-ohmic and the transistor $M_{Swi}$ 2 is conductive and an electric current $I_{OLED}$ can flow from LVDD through the transistors $M_{Drive}$ 1, $M_{Swi}$ 2 and $M_{MV}$ 4 into the organic light-emitting diode 5. The magnitude of the electric current in this respect depends on the electric voltage $V_{Drive}$ and can be set over several decades. In this respect, the linearity of the image representation is not influenced since the representation of color gradations/gray-scale stages can be implemented via the initially described pulse width modulation.

If the input voltage signal is connected to LVDD (high), the driver circuit 30 is deactivated. In this case, the transistor $M_{Swi}$ 2 is high-ohmic and the transistor $M_{NSWi}$ 3 is electrically conductive. The transistor $M_{NSWi}$ 3 switches the node $V_{SMV}$ to VSS and protects the actual current source transistor $M_{Drive}$ 1 and the transistor $M_{Swi}$ 2 from electric surge voltages (in this case, voltages less than VSS). Only a very small electric leak current can thus flow through the transistor $M_{MV}$ 4 (high-ohmic) and the electric current through the organic light-emitting diode 5 becomes so small that the latter no longer lights up. The electric voltage difference over the organic light-emitting diode 5 ($V_{Anode}-V_{Cathode}$) thus becomes smaller than the electric voltage applied to the organic light-emitting diode 5 with an electric current flow because the electric voltage $V_{Anode}$ approaches the voltage $V_{Cathode}$.

A special case for operation is present when the electric voltage $V_{Drive}$ is switched to VSS. In this case, the transistor $M_{Drive}$ 1 operates as a switch the drive circuit 30 works as an electric voltage source for the organic light-emitting diode 5 which provides the electric voltage LVDD in the switched-on state.

The driver circuit 30 can therefore accordingly be utilized both as an electric current source and voltage source.

The driver circuit 30 can control a maximum electric voltage difference at the organic light-emitting diode 5 which ranges from 0 volts in the switched-off state to (LVDD–$V_{Cathode}$) in the switched-on state. In this respect, the electric voltage $V_{Cathode}$ (less than 0 volts) may be so large as a maximum in amount as the permitted drain sensor voltage of the transistor $M_{MV}$ 4. Depending on the choice of the CMOS technology (and on the corresponding medium volt/high volt option), a voltage stroke from 5 V up to 15 V from the switched on to the switched off state can thus be realized at the organic light-emitting diode 5.

The invention claimed is:

1. A circuit arrangement for organic light-emitting diodes arranged in a two-dimensional matrix in which every organic light-emitting diode can be controlled, the circuit arrangement comprising:

a storage circuit, a sense amplifier and a driver circuit, wherein the driver circuit includes at least first, second, and third transistors connected in series and a further output transistor whose drain is connected to an anode of a respective organic light-emitting diode and whose gate is connected to a ground potential or to which negative electric voltage is applied and in this respect the first transistor acting as a driver is acted on by a constant electric operating voltage LVDD at its source and by a further likewise constant electric operating voltage $V_{Drive}$ at its gate; with a drain of the first transistor being connected to a source of the following second transistor connected in series to it and the two gates of the second and third transistors forming a switch being connected to the output of the sense amplifier and being acted on by its electric output voltage $V_{senseout}$; and the drain of the second transistor forming the switch being connected to the source of the output transistor whose gate is connected to ground potential or to which negative electric voltage is applied, wherein the second transistor which is connected at its source to the first transistor acting as a driver is a PMOS transistor and the third transistor whose gate is connected with the gate of the second transistor together to the output of the sense amplifier is an NMOS transistor, and wherein a source of the third transistor and a gate of the output transistor being connected to the same ground potential or to which the same negative electric voltage is applied.

2. The circuit arrangement in accordance with claim 1, wherein all elements of the circuit arrangement are formed as a CMOS circuit on a semiconductive substrate.

3. The circuit arrangement in accordance with claim 1, wherein a further transistor is arranged between the first transistor acting as a driver and the second transistor, connected in series, to switch off the driver circuit.

4. The circuit arrangement in accordance with claim 3, wherein the further transistor is a PMOS transistor.

5. The circuit arrangement in accordance with claim 1, wherein an electric voltage is applied to the cathode of the organic light-emitting diode which is smaller than the electric voltage which is applied to the source of the third transistor and to the gate of the output transistor connected to the anode of the organic light-emitting diode.

6. The circuit arrangement in accordance with claim 1, wherein the gate of the first transistor acting as a driver is connected to ground potential and this first transistor forms a switch of the driver circuit.

* * * * *